US007768205B2

(12) United States Patent
Kim

(10) Patent No.: US 7,768,205 B2
(45) Date of Patent: Aug. 3, 2010

(54) PLASMA DISPLAY PANEL AND METHOD OF MANUFACTURING THE SAME

(75) Inventor: Jong-Won Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 311 days.

(21) Appl. No.: 11/898,243

(22) Filed: Sep. 11, 2007

(65) Prior Publication Data

US 2008/0116804 A1 May 22, 2008

(30) Foreign Application Priority Data

Nov. 17, 2006 (KR) ..... 10-2006-0113971

(51) Int. Cl.
*H01J 17/49* (2006.01)

(52) U.S. Cl. ..... 313/586; 313/587; 445/24

(58) Field of Classification Search ..... 313/582–587; 445/24–25

See application file for complete search history.

(56) References Cited

U.S. PATENT DOCUMENTS 6,252,353 B1 * 6/2001 Ha et al. ..... 313/582
2002/0063526 A1 * 5/2002 Mizobata ..... 313/586
2005/0140579 A1 * 6/2005 Yoo ..... 345/60

* cited by examiner

*Primary Examiner*—Nimeshkumar D Patel
*Assistant Examiner*—Anne M Hines
(74) *Attorney, Agent, or Firm*—Lee & Morse, P.C.

(57) ABSTRACT

A plasma display panel (PDP) includes a front substrate, a rear substrate facing the front substrate, barrier ribs between the front and rear substrates to define a plurality of discharge cells, photoluminescent material in the discharge cells, first electrodes on the front substrate along a first direction, second electrodes on the rear substrate and extending in a second direction crossing the first direction, at least one dielectric layer on the rear substrate, and a white pigment layer on the substrate.

20 Claims, 5 Drawing Sheets

PLASMA DISPLAY PANEL AND METHOD OF MANUFACTURING THE SAME

BACKGROUND OF THE INVENTION

1. Field of the Invention

Embodiments of the present invention relate to a plasma display panel (PDP) and a method of manufacturing the same. More particularly, embodiments of the present invention relate to a PDP having a structure capable of improving reflectivity of visible light from a rear substrate thereof, while decreasing power consumption of the PDP.

2. Description of the Related Art

A plasma display panel (PDP) refers to a display device capable of displaying images via gas discharge phenomenon, i.e., use of vacuum ultraviolet (VUV) light emitted from plasma discharge to excite photoluminescent material, consequently emitting visible light to form images. Accordingly, the PDP may provide superior display characteristics, such as thin display, excellent color reproduction, and wide viewing angle, as compared to conventional display devices.

The conventional PDP, e.g., AC three-electrode surface-discharge type PDP, may include a plurality of pairs of display electrodes on a front substrate, a plurality of address electrodes on a rear substrate, a plurality of barrier ribs defining a plurality of discharge cells between the first and second substrates, and a photoluminescent material in the discharge cells. The discharge cells of the conventional PDP may be configured in a grid pattern, and may be selectively turned on and off with respect to accumulation of wall charges generated by display and address electrodes operation, so that selected discharge cells may emit visible light via excitation of the photoluminescent material. The visible light emitted from the discharge cells may form an image on the front substrate.

The conventional PDP may also include a dielectric layer mixed with a white filler on the rear substrate. The white filler may increase whiteness of the dielectric layer, so that the visible light emitted from the discharge cells toward the rear substrate may be reflected toward the front substrate to reduce potential loss of visible light through the rear substrate. However, an increased amount of white filler in the dielectric layer may increase permittivity of the dielectric layer, thereby increasing power consumption of the PDP. Further, increased amount of white pigment may increase a firing temperature, thereby limiting whiteness in the PDP. Limited whiteness may limit the amount of visible light reflected from the dielectric layer toward the front substrate, and thereby, reduce overall luminance of the PDP. Accordingly, there exists a need for a PDP capable of improving reflectivity of visible light from a rear substrate, while minimizing the amount of white filler in the dielectric layer.

SUMMARY OF THE INVENTION

Embodiments of the present invention are therefore directed to a plasma display panel (PDP) and a method of manufacturing the same, which substantially overcome one or more of the disadvantages of the related art.

It is therefore a feature of an embodiment of the present invention to provide a PDP capable of improving reflectivity of visible light from a rear substrate, while minimizing an amount of white pigment in the dielectric layer.

It is another feature of an embodiment of the present invention to provide a method of manufacturing a PDP capable of improving reflectivity of visible light from a rear substrate, while minimizing an amount of white pigment in the dielectric layer.

At least one of the above and other features and advantages of the present invention may be realized by providing a PDP including a front substrate, a rear substrate facing the front substrate, barrier ribs between the front and rear substrates to define a plurality of discharge cells, photoluminescent material in the discharge cells, first electrodes on the front substrate along a first direction, second electrodes on the rear substrate and extending in a second direction crossing the first direction, at least one dielectric layer on the rear substrate, and a white pigment layer on the rear substrate. The white pigment layer may be between the at least one dielectric layer and the rear substrate. Alternatively, the at least one dielectric layer may be between the white pigment layer and the rear substrate.

The white pigment layer may have a greater whiteness than the dielectric layer. The white pigment layer may include a larger amount of a white pigment than the dielectric layer. The white pigment may be zirconium oxide ($ZrO_2$), boron nitrogen ($B_3N_4$), or titanium oxide ($TiO_2$). The at least one dielectric layer may have a lower permittivity than the white pigment layer.

The first electrodes may be address electrodes, and the second electrodes may be display electrodes. Alternatively, the first electrodes may be display electrodes, and the second electrodes may be address electrodes.

The PDP may further include a plurality of dielectric layers on the rear substrate. The white pigment layer may be between the plurality of dielectric layers. The white pigment layer may be continuous. The white pigment layer and the dielectric layer may be entirely discrete layers.

At least one of the above and other features and advantages of the present invention may be also realized by providing a method of manufacturing a PDP, including forming electrodes on a substrate, forming a dielectric film including at least one dielectric film layer and a white pigment film layer, laminating the dielectric film on the substrate to cover the electrodes, and firing the dielectric film on the substrate to form a dielectric layer. Laminating the dielectric film may include disposing the dielectric film layer to be in contact with the substrate.

Forming the dielectric film may include employing a white pigment film layer having a greater whiteness than the dielectric film layer. Employing a white pigment film layer having a greater whiteness than the dielectric film layer may include employing a white pigment film layer having a larger amount of white pigment than the dielectric film layer. Employing the white pigment may include employing zirconium oxide ($ZrO_2$), boron nitrogen ($B_3N_4$), or titanium oxide ($TiO_2$).

Forming the dielectric film may include employing a white pigment film layer having a higher permittivity than the dielectric film layer. Forming the dielectric film may include employing a white pigment between a plurality of dielectric film layers.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
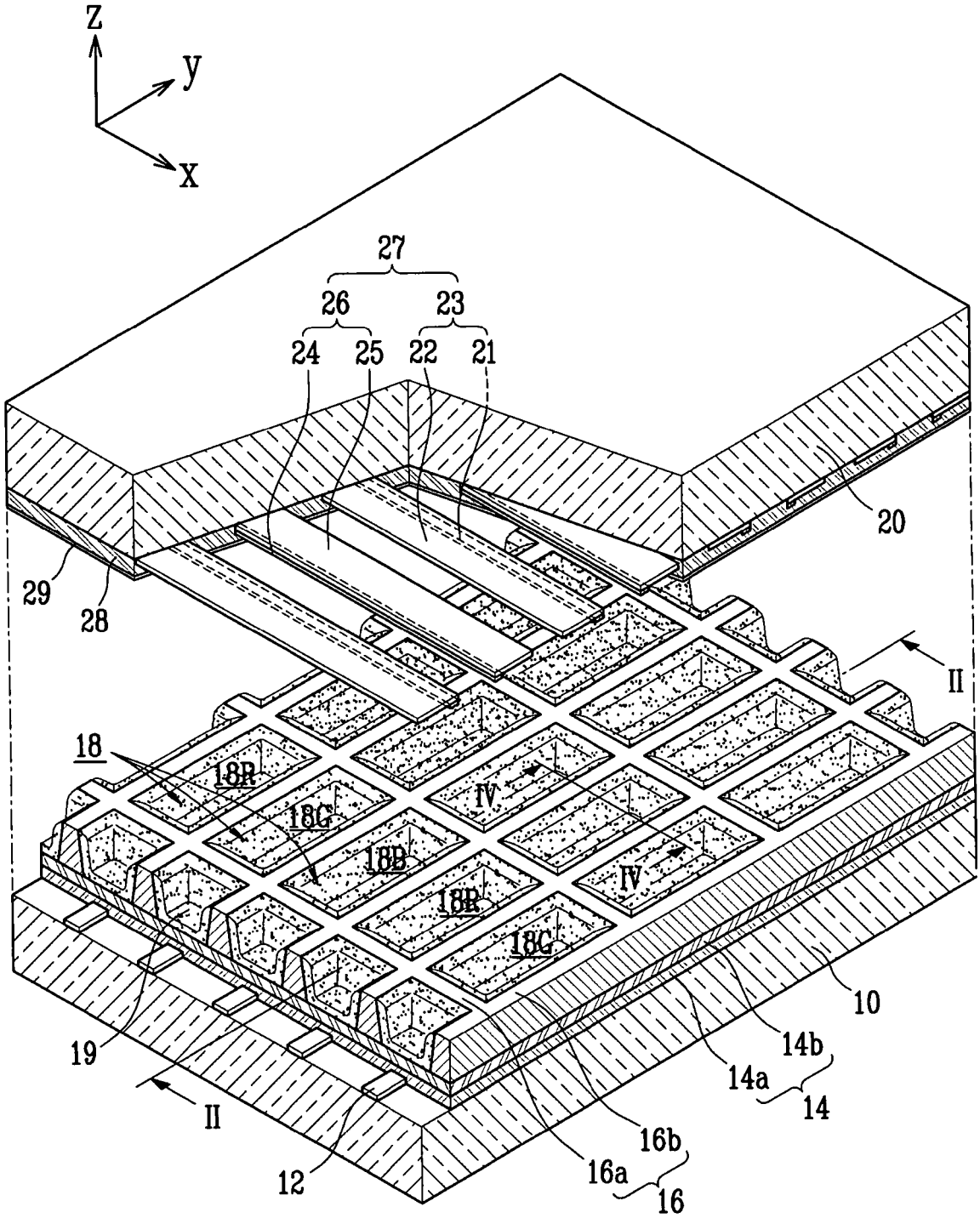
FIG. 1 illustrates a partially cut away exploded perspective view of a plasma display panel (PDP) according to an embodiment of the present invention.

Korean Patent Application No. 10-2006-0113971, filed on Nov. 17, 2006, in the Korean Intellectual Property Office, and entitled: "Plasma Display Panel and Method of Manufacturing the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
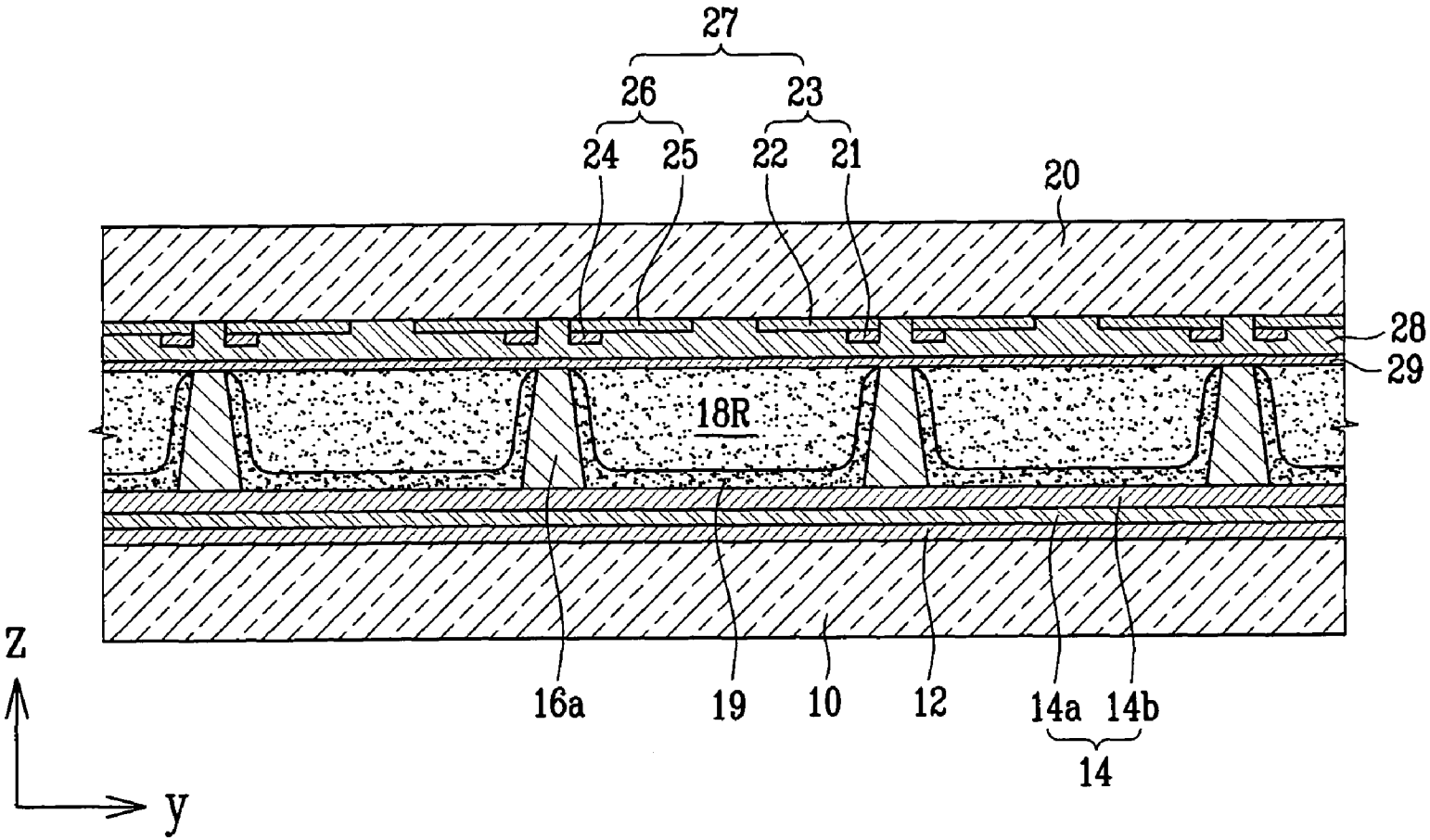
FIG. 2 illustrates a cross-sectional view along line II-II of FIG. 1.

An exemplary embodiment of a plasma display panel (PDP) according to the present invention will now be described more fully with reference to FIGS. 1-2. As illustrated in FIGS. 1-2, a PDP according to an embodiment of the present invention may include a rear substrate 10, a front substrate 20 parallel to the rear substrate 10, a plurality of display electrodes 27 on the front substrate 20, a plurality of address electrodes 12 on the rear substrate 10, a plurality of barrier ribs 16 between the rear and front substrates 10 and 20 to define a plurality of discharge cells 18, and a dielectric sheet 14 on the rear substrate 10.

The plurality of display electrodes 27 of the PDP according to an embodiment of the present invention may include pairs of scan and sustain electrodes 23 and 26 on the front substrate 20 along a first direction, i.e., the x-axis, so that each discharge cell 18 may be positioned between the scan and sustain electrodes 23 and 26 of one pair of display electrodes 27, as illustrated in FIG. 2. The plurality of address electrodes 12 may extend along a second direction, i.e., the y-axis, so that each discharge cell 18 may correspond to a single address electrode 12, as illustrated in FIG. 1. It should be noted however, that other configuration of display and address electrodes 27 and 12, e.g., the address electrodes 12 may be formed on the front substrate 20, while the display electrodes 27 may be formed on the rear substrate 10, are not excluded from the scope of the present invention.

Each scan and sustain electrode 23 and 26 of the display electrodes 27 according to an embodiment of the present invention may include respective transparent electrodes 22 and 25 along the x-axis and respective bus electrodes 21 and 24 along the x-axis, as illustrated in FIGS. 1-2. The transparent electrodes 22 and 25 may extend along transverse barrier ribs 16*a*. Further, the transparent electrodes 22 and 25 may be wider, i.e., as measured along the y-axis, than the respective bus electrodes 21 and 24, and may extend widthwise from the respective bus electrodes 21 and 24 toward centers of respective discharge cell 18. The transparent electrodes 22 and 25 may be made of indium-tin-oxide (ITO) to facilitate transmission of visible light, and may correspond to each of the red, green, and blue discharge cells 18R, 18G, and 18B.

The bus electrodes 21 and 24 of the display electrodes 27 according to an embodiment of the present invention may be made of metal having high electro-conductivity to compensate for a voltage drop caused by the transparent electrodes 22 and 25. Further, the bus electrodes 21 and 24 may vertically protrude downward from respective transparent electrodes 22 and 25 toward the discharge cells 18, i.e., positioned in close proximity to the transverse barrier ribs 16*a*, in order to increase transmittance of the visible light generated in the discharge cells 18 during plasma discharge. The bus electrodes 21 and 24 may be disposed along the transverse barrier ribs 16*a*. It should be noted, however, that other configurations of the transparent electrodes 22 and 25, and bus electrodes 21 and 24, e.g., the transparent electrodes 22 and 25 may be formed to correspond to the red, green, and blue discharge cells 18R, 18G and 18B, and may individually protrude from respective bus electrodes 21 and 24, are not excluded from the scope of the present invention.

The display electrodes 27 may be coated with an upper dielectric layer 28 and a passivation layer 29, as illustrated in FIGS. 1-2. The upper dielectric layer 28 may be disposed to cover the scan and sustain electrodes 23 and 26. The passivation layer 29 may be formed on the upper dielectric layer 28 to minimize exposure of the upper dielectric layer 28 to plasma discharge in the discharge cells 18. The passivation layer 29 may be formed of magnesium oxide (MgO) to shield the upper dielectric layer 28, while providing visible light transmittance and high secondary electron emission coefficient. In this case, a discharge ignition voltage may be lowered.

The barrier ribs 16 of the PDP according to an embodiment of the present invention may include longitudinal barrier ribs 16*b* and transverse barrier ribs 16*a*, as illustrated in FIG. 1. The longitudinal barrier ribs 16*b* may extend along the first direction, i.e., along the y-axis, and the transverse barrier ribs 16*a* may extend along the second direction, i.e., along the x-axis, so that the longitudinal and transverse barrier ribs 16*b* and 16*a* may intersect to form, e.g., a grid pattern. Therefore, the discharge cells 18 may have a rectangular cross-sectional area defined by the barrier ribs 16. It should be noted, however, that other configurations of barrier ribs 16, e.g., a stripe pattern, a delta pattern, and so forth, are not excluded from the scope of the present invention. Accordingly, other cross-sectional areas of discharge cells 18, e.g., circular, triangular, and so forth, are not excluded from the cope of the present invention either. The plurality of barrier ribs 16 may be formed by coating a barrier forming paste on the rear substrate 10, followed by drying, patterning, and firing processes. The barrier ribs may be formed independently from the rear substrate 10.

The discharge cells 18 of the PDP according to an embodiment of the present invention may include a photoluminescent material. More specifically, a plurality of red, green, and blue phosphor layers 19 may be disposed in respective inner portions 18R, 18G, and 18B of the discharge cells 18, as illustrated in FIG. 1. The inner portions 18R, 18G and 18B of the discharge cells 18 may be filled with a discharge gas, e.g., a mixture of xenon (Xe) and neon (Ne), for generating plasma discharge.

The dielectric sheet 14 of the PDP according to an embodiment of the present invention may be disposed on the rear substrate 10 to cover the address electrodes 12, i.e., protect the address electrodes from plasma discharge, and may include a lower dielectric layer 14*a* and a white pigment layer 14*b*, as illustrated in FIGS. 1-2. The lower dielectric layer 14*a* and the white pigment layer 14*b* may be discrete layers in communication with one another, and may be disposed on the address electrodes 12 in any order determined by one of ordinary skill in the art.

Figure 3:
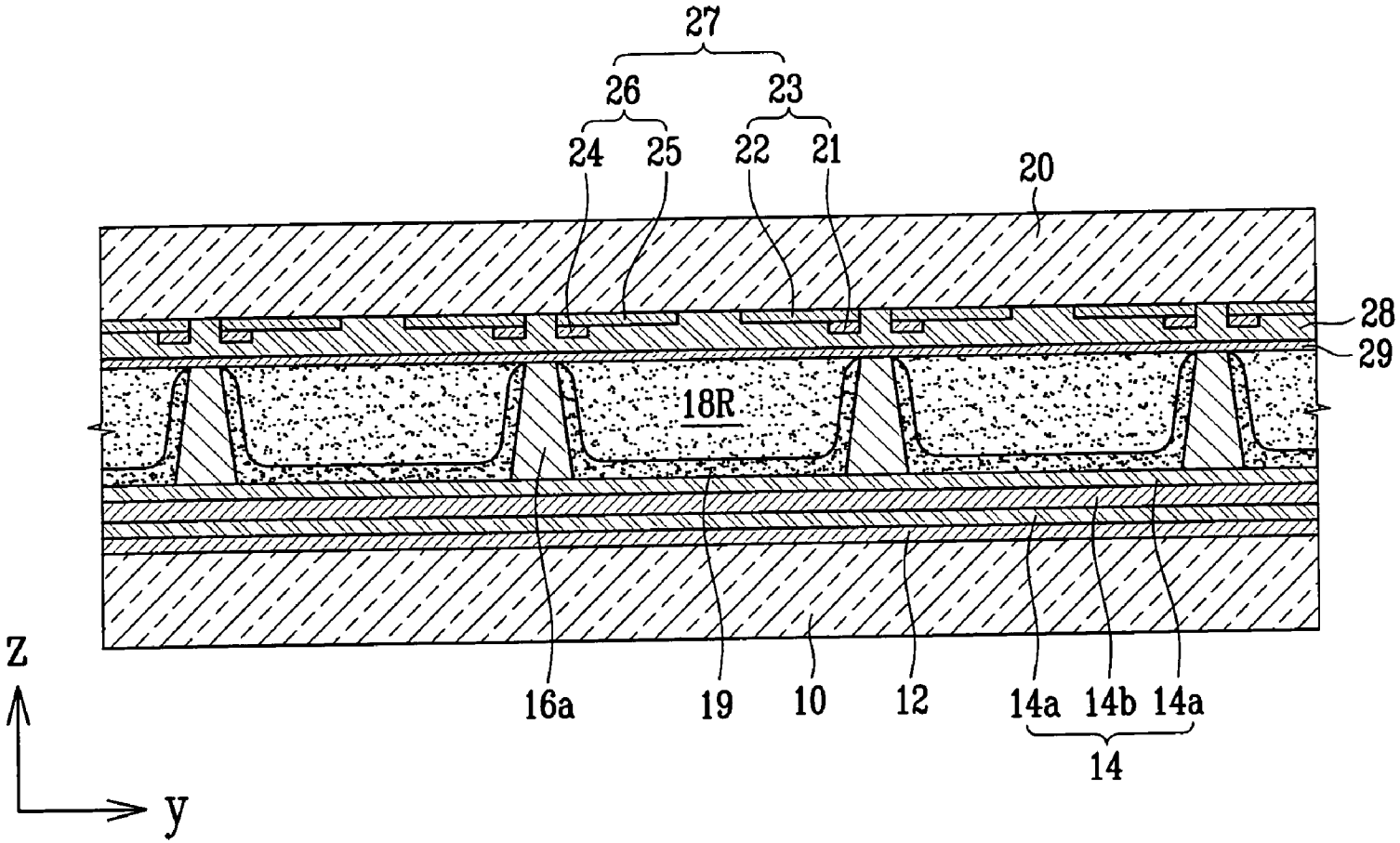
FIG. 3 illustrates a cross-sectional view of a plasma display panel (PDP) according to another alternative embodiment of the present invention.

For example, the lower dielectric layer 14*a* may be positioned between the rear substrate 10 and the white pigment layer 14*b*, as illustrated in FIGS. 1-2. Alternatively, the white pigment layer 14*b* may be positioned between the rear substrate 10 and the lower dielectric layer 14*a* (not shown), so that the white pigment layer 14*b* may be in contact with the rear substrate 10. In yet another alternative, as shown in FIG. 3, the dielectric sheet 14 may include a plurality of lower dielectric layers 14*a* with at least one white pigment layers 14*b* therebetween, so that at least one lower dielectric layer 14*a* may be positioned between the rear substrate 10 and the white pigment layer 14*b*.

The lower dielectric layer 14*a* may be made of a lead-free dielectric material, e.g., a mixture of zinc borosilicate ($ZnO—B_2O_3—SiO_2$), bismuth borosilicate ($Bi_2O_3—B_2O_3—SiO_2$), and so forth, or a lead-bearing dielectric material, e.g., a mixture of lead borosilicate ($PbO—B_2O_3—SiO_2$). If the lower dielectric layer 14*a* is made of a lead-free material, the permittivity may be about seven (7) to about nine (9) for zinc-based materials, and about twelve (12) to about thirteen (13) for bismuth-based materials. If the lower dielectric layer 14*a* is made of a lead-bearing material, the permittivity may be about twelve (12) to about fourteen (14). Increased permittivity may enhance current through the address electrodes 12, thereby triggering increased PDP power consumption. Accordingly, use of lead-free materials, i.e., a material having lower permittivity, in the lower dielectric layer 14*a* may be preferred in order to decrease power consumption.

The white pigment layer 14*b* may include a lead-free or a lead-bearing dielectric material, e.g., the same material employed to form the lower dielectric layer 14*a*, and an additive. The additive of the white pigment layer 14*b* may be a white pigment, e.g., zirconium oxide ($ZrO_2$), boron nitrogen ($B_3N_4$), titanium oxide ($TiO_2$), aluminum oxide ($Al_2O_3$), and so forth. Use of the white pigment in the white pigment layer 14*b* may provide higher whiteness thereto, i.e., higher purity of white color with respect to RGB white color coordinates, as compared to the lower dielectric layer 14*a*.

The increased whiteness of the white pigment layer 14*b* may increase reflectivity of visible light from the rear substrate 10 toward the front substrate 20, thereby enhancing the amount of visible light transmitted through the front substrate 20, as will be discussed in more detail with respect to FIG. 4. It should be noted, however, that when the same $TiO_2$ content is used in the lead-free material and the lead-bearing material, the reflectivity of the lead-free material may be lower than the reflectivity of the lead-bearing material. Without intending to be bound by theory, it is believed that increased whiteness of the white pigment layer 14*b* may decrease a luminance ratio between the rear and front substrates 10 and 20, thereby increasing reflectivity of the white pigment layer 14*b* and decreasing loss of luminance through the rear substrate 10 to enhance overall luminance of the front substrate 20.

Additionally, use of the white pigment in the white pigment layer 14*b* may increase strength, e.g., minimize cracking thereof during firing operation, and permittivity thereof. Accordingly, the pigment layer 14*b* may have a higher permittivity than the lower dielectric layer 14*a*. For example, the permittivity of the white pigment layer 14*b* may be about 30 when using $TiO_2$ as an additive. Increased permittivity of the white pigment layer 14*b*, as opposed to the lower dielectric layer 14*a*, may provide decreased power consumption in the address electrodes 12 and reduced heat generated in a TCP during operation of high resolution panels, e.g., a full HD scan.

Operation of the PDP according to an embodiment of the present invention may be as follows. Voltage may be applied to the address and scan electrodes 12 and 23 to select discharge cells 18, i.e., discharge cells 18 to be turned on. Next, voltage may be applied between the scan and sustain electrodes 23 and 26 to generate plasma discharge in the selected discharge cells 18, thereby emitting visible light for displaying images.

Figure 4:
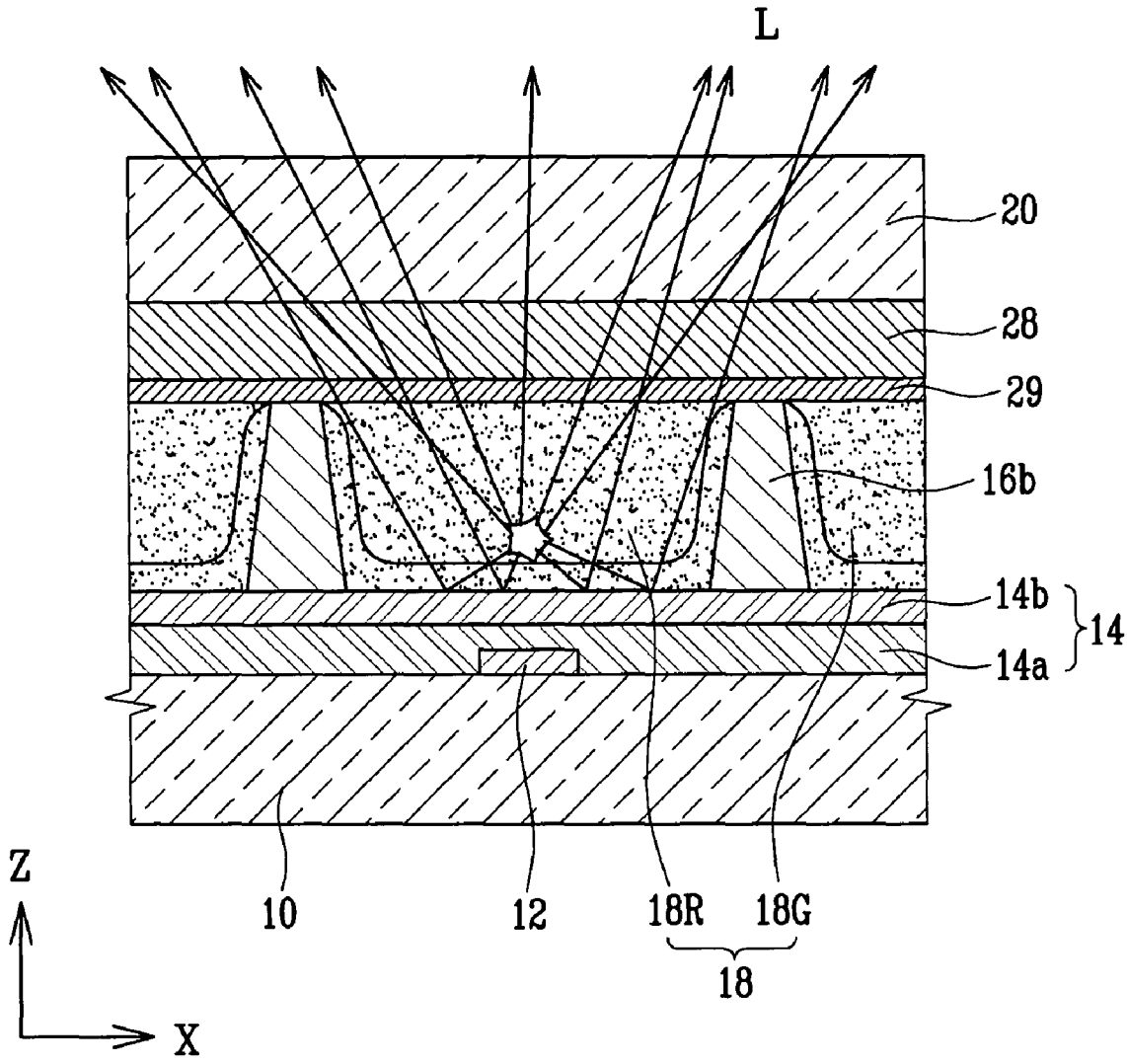
FIG. 4 illustrates a cross-sectional view along line IV-IV of FIG. 1.

More specifically, as illustrated in FIG. 4 with respect to line IV-IV of FIG. 1, visible light L may be emitted from, e.g., the inner spaces 18R, toward the front and rear substrates 20 and 10. The visible light L emitted from the discharge cells 18 toward the rear substrate 10 may be incident on the dielectric sheet 14, and may be reflected from the white pigment layer 14*b* of the dielectric sheet 14 toward the front substrate 20, as further illustrated in FIG. 4. Accordingly, the amount of visible light L transmitted through the front substrate 20 may be substantially increased, thereby enhancing overall luminance and display performance of the PDP.

According to another exemplary embodiment of the present invention, a method of manufacturing the dielectric sheet 14 of a PDP will be illustrated in more detail with respect to FIGS. 5A-5E. It should be noted that the exemplary method illustrated in FIGS. 5A-5E refers to the PDP described previously with respect to FIGS. 1-3, and therefore, detailed description of like elements will not be repeated herein.

Figure 5A:
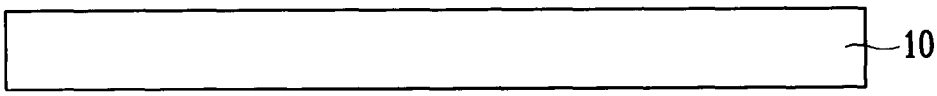
FIGS. 5A to 5E illustrate cross-sectional views of sequential steps in forming a dielectric sheet of a PDP according to an embodiment of the present invention.
Figure 5B:
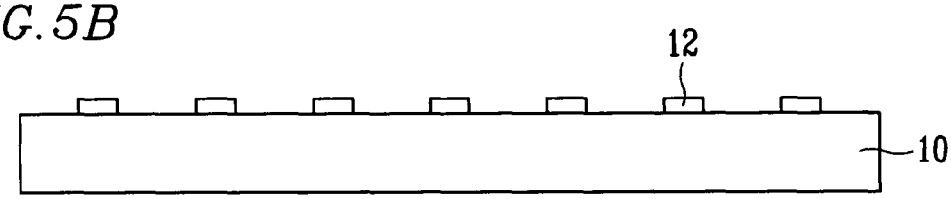

As illustrated in FIGS. 5A-5B, the plurality of address electrodes 12 may be disposed on the rear substrate 10. The address electrodes 12 may be formed by screen printing a metal paste, e.g., gold (Au) or silver (Ag), on to the rear substrate 10. Alternatively, the address electrodes 12 may be formed by coating the metal paste onto the rear substrate 10 to form an electrode layer and patterning the electrode layer by sandblasting or etching. It should be noted, however, that other methods to form the address electrodes 12, e.g., patterning a photosensitive electrode layer by exposure and development and/or photolithography, are not excluded from the scope of the present invention.

Figure 5C:
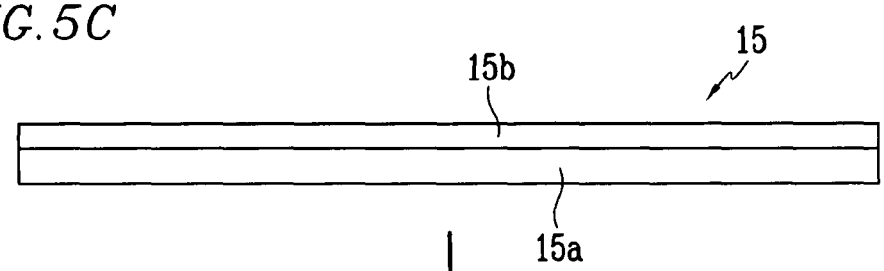

Next, as illustrated in FIG. 5C, a dielectric film 15 may be formed by sequentially depositing a dielectric film layer 15*a* and a white pigment film layer 15*b* onto a base film (not shown). As described previously with respect to FIGS. 1-2, the dielectric film layer 15*a* may include a dielectric material, and the white pigment film layer 15*b* may include the same dielectric material as the dielectric film layer 15*a* and a white pigment as an additive. Therefore, the dielectric film layer 15*a* may have a lower permittivity and whiteness than the white pigment film layer 15*b*. Further, as described previously with respect to FIGS. 1-2, the dielectric film 15 may have a plurality of dielectric film layers 15*a* with at least one white pigment film layer 15*b* therebetween.

Figure 5D:
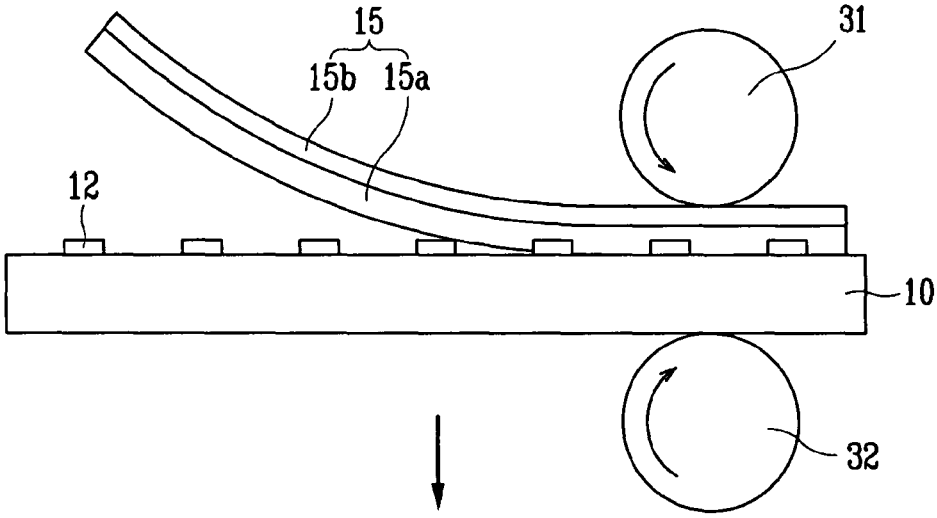

Subsequently, as illustrated in FIG. 5D, the dielectric film 15 may be laminated onto the rear substrate 10 with a carrier roller 31 and a press roller 32 so that the dielectric film 15 may cover the address electrodes 12. More specifically, the dielectric film 15 may be laminated onto the rear substrate 10, so that the dielectric film layer 15*a* may be in contact with the rear substrate 10 and with the address electrodes 12. Alternatively, the dielectric film 15 may be laminated onto the rear substrate 10, so that the white pigment sheet layer 15*b* may be disposed to be in contact with the rear substrate 10 and the address electrodes 12.

Figure 5E:
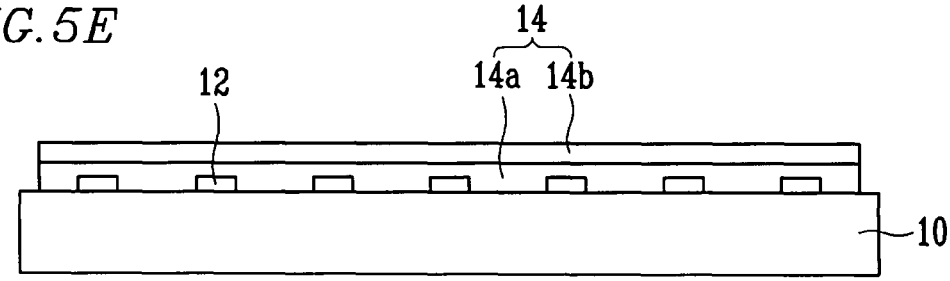

Next, as illustrated in FIG. 5E, a firing process may be performed on the dielectric film 15 laminated onto the rear substrate 10 to simultaneously form the lower dielectric layer 14*a* and the white pigment layer 14*b* on the rear substrate 10. Therefore, it is possible to reduce manufacturing processes and manufacturing costs.

Once the dielectric sheet 14 is formed, the barrier ribs 16 and the phosphor layers 19 may be deposited on the dielectric sheet 14. The display electrodes 27, the upper dielectric layer 28, and the passivation layer 29 may be sequentially disposed on the front substrate 20, followed by assembly of the front and rear substrates 20 and 10, such that the display electrodes 27 on the front substrate 20 face the address electrodes 12 on the rear substrate 10, to complete formation of the PDP.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:
a front substrate;
a rear substrate facing the front substrate;
barrier ribs between the front and rear substrates to define a plurality of discharge cells;
photoluminescent material in the discharge cells;
first electrodes on the front substrate along a first direction;
second electrodes on the rear substrate and extending in a second direction crossing the first direction;
at least one dielectric layer on the rear substrate overlapping a first surface of the barrier ribs; and
a white pigment layer on the rear substrate overlapping the first surface of the barrier ribs, the white pigment layer overlapping substantially an entire length of the dielectric layer and the dielectric layer overlapping substantially an entire length of the white pigment layer.

2. The PDP as claimed in claim 1, wherein the white pigment layer is between the at least one dielectric layer and the rear substrate.

3. The PDP as claimed in claim 1, wherein the at least one dielectric layer is between the white pigment layer and the rear substrate.

4. The PDP as claimed in claim 1, wherein the white pigment layer has a greater whiteness than the dielectric layer.

5. The PDP as claimed in claim 1, wherein the white pigment layer includes a white pigment.

6. The PDP as claimed in claim 5, wherein the white pigment includes zirconium oxide ($ZrO_2$), boron nitrogen ($B_3N_4$), aluminum oxide ($Al_2O_3$), or titanium oxide ($TiO_2$).

7. The PDP as claimed in claim 1, wherein the at least one dielectric layer has a lower permittivity than the white pigment layer.

8. The PDP as claimed in claim 1, wherein:
the first electrodes are address electrodes and the second electrodes are display electrodes, and
the first surface of the barrier ribs extends along the first direction and faces the rear substrate.

9. The PDP as claimed in claim 1, wherein:
the first electrodes are display electrodes and the second electrodes are address electrodes, and
the first surface of the barrier ribs extends along the second direction and faces the rear substrate.

10. The PDP as claimed in claim 1, further comprising a plurality of dielectric layers on the rear substrate.

11. The PDP as claimed in claim 10, wherein the white pigment layer is between the plurality of dielectric layers.

12. The PDP as claimed in claim 1, wherein:
the white pigment layer and the dielectric layer are continuous and discrete layers, and
the white pigment layer and the dielectric layer overlap substantially an entire length and width of the rear substrate.

13. The PDP as claimed in claim 1, wherein the white pigment layer and the dielectric layer are entirely discrete layers.

14. A method of manufacturing a PDP, comprising:
forming electrodes on a substrate;
forming a dielectric film including at least one dielectric film layer and a white pigment film layer;
laminating the dielectric film on the substrate to cover the electrodes;
firing the dielectric film on the substrate to form a dielectric layer; and
forming barrier ribs on the dielectric layer, the at least one dielectric film layer and the white pigment film layer overlapping a first surface of the barrier ribs, the white pigment film layer overlapping substantially an entire length of the dielectric film layer and the dielectric film layer overlapping substantially an entire length of the white pigment film layer.

15. The method as claimed in claim 14, wherein laminating the dielectric film includes disposing the dielectric film layer to be in contact with the substrate.

16. The method as claimed in claim 14, wherein forming the dielectric film includes employing a white pigment film layer having a greater whiteness than the dielectric film layer.

17. The method as claimed in claim 16, wherein employing the white pigment film layer includes employing zirconium oxide ($ZrO_2$), boron nitrogen ($B_3N_4$), aluminum oxide ($Al_2O_3$), or titanium oxide ($TiO_2$).

18. The method as claimed in claim 14, wherein forming the dielectric film includes employing a white pigment film layer having a higher permittivity than the dielectric film layer.

19. The method as claimed in claim 14, wherein forming the dielectric film includes forming the dielectric film layer and the white pigment film layer as distinct layers.

20. The method as claimed in claim 14, wherein forming the dielectric film includes employing a white pigment between a plurality of dielectric film layers.

* * * * *